US007470201B2

(12) United States Patent
Nakahara et al.

(10) Patent No.: US 7,470,201 B2
(45) Date of Patent: Dec. 30, 2008

(54) HOLLOW GOLF CLUB HEAD

(75) Inventors: Norihiko Nakahara, Kanagawa (JP); Shinji Yamamoto, Kanagawa (JP)

(73) Assignee: The Yokohama Rubber Co., Ltd., Tokyo (JP)

( * ) Notice: Subject to any disclaimer, the term of this patent is extended or adjusted under 35 U.S.C. 154(b) by 192 days.

(21) Appl. No.: 10/537,775

(22) PCT Filed: Dec. 8, 2003

(86) PCT No.: PCT/JP03/15671

§ 371 (c)(1),
(2), (4) Date: Jun. 6, 2005

(87) PCT Pub. No.: WO2004/052474

PCT Pub. Date: Jun. 24, 2004

(65) Prior Publication Data

US 2006/0052177 A1 Mar. 9, 2006

(30) Foreign Application Priority Data

Dec. 6, 2002 (JP) ..... 2002-355820

(51) Int. Cl.
*A63B 53/04* (2006.01)

(52) U.S. Cl. ..... 473/345; 473/348

(58) Field of Classification Search ..... None
See application file for complete search history.

(56) References Cited

U.S. PATENT DOCUMENTS

| | | | | |
|---|---|---|---|---|
| 5,378,295 | A | 1/1995 | Yamashita et al. | |
| 6,471,604 | B2 | 10/2002 | Hocknell et al. | |
| 6,743,118 | B1 * | 6/2004 | Soracco | 473/342 |
| 7,156,750 | B2 * | 1/2007 | Nishitani et al. | 473/329 |
| 7,163,470 | B2 * | 1/2007 | Galloway et al. | 473/342 |
| 2003/0083151 | A1 * | 5/2003 | Nakahara et al. | 473/345 |

FOREIGN PATENT DOCUMENTS

| | | |
|---|---|---|
| JP | 59-46566 | 3/1984 |
| JP | 1-171583 | 7/1989 |
| JP | 5-317466 | 3/1993 |
| JP | 07155410 A * | 6/1995 |
| JP | 07-213655 | 8/1995 |
| JP | 10-155943 | 6/1998 |
| JP | 10-263118 | 10/1998 |

* cited by examiner

*Primary Examiner*—Gene Kim
*Assistant Examiner*—Alvin A Hunter
(74) *Attorney, Agent, or Firm*—Finnegan, Henderson, Farabow, Garrett & Dunner, L.L.P.

(57) ABSTRACT

A golf club head of the present invention includes a face portion having an impact surface that impacts a golf ball and is made from a metallic material, and a crown portion, a heel portion, a sole portion, and the toe portion that are adjacent to the face portion. In at least two portions from among the crown portion, the heel portion, the sole portion, and the toe portion, at least one from among dissimilar metallic materials that differ from the metallic material of the impact surface and fiber reinforced plastic materials is used in regions along ends that are adjacent to the face portion, within a range of 30 mm from the adjacent ends. Thereby, the golf club has a structure that easily deforms with respect to golf ball impacts, and the face portion deforms more than conventional face portions. The coeffecient of restitution of a struck golf ball therefore increases, the initial velocity of the golf ball increases, and the carry distance increases.

4 Claims, 9 Drawing Sheets

HOLLOW GOLF CLUB HEAD

TECHNICAL FIELD

The present invention relates to a hollow golf clubhead having a face portion in which an impact surface that impacts a golf ball is made from a metallic material, a crown portion that is adjacent to the face portion, a heel portion, a sole portion, and a toe portion.

BACKGROUND ART

It has become known in recent years that the coefficient of restitution of a golf ball can be increased in a metallic hollow golf club head by using a titanium alloy or the like for an impact surface that impacts a golf ball, and in addition, by making the thickness of a face member that forms the impact surface thinner, or by making portions of a joining edge, where the face member is joined to other members such as a crown member and a sole member, partially thinner.

JP 10-155943 A discloses a hollow golf club head in which a thin portion is provided in an inner circumferential edge of a golf ball impact surface. Elastic deformation of the impact surface during golf ball impacts is thus promoted, thus increasing the restitution coefficient of the struck golf ball which results in an increase of the carry distance of the golf ball.

However, if the face member is made thinner in its entirety or partially, the rigidity of the face member itself decreases, and the mechanical strength with respect to an impact force during golf ball impacts decreases. Accordingly, there is a limit to how thin the face member can be made. A problem therefore exists in that the coefficient of restitution of a struck golf ball cannot be increased further by the above-described method of making the face member thinner in its entirety or partially.

DISCLOSURE OF THE INVENTION

An object of the present invention is thus to provide a hollow golf club head capable of increasing the coefficient of restitution of a struck golf ball to increase the carry distance of the golf ball, by a method that differs completely from the method described above of increasing the coefficient of restitution by changing the thickness of a face member.

In order to achieve the above object, according to the present invention, there is provided a hollow golf club head, including a face portion having an impact surface that impacts a golf ball and is made from a metallic material, and a crown portion, a heel portion, a sole portion, and a toe portion that are adjacent to the face portion, characterized in that, in at least two portions from among the crown portion, the heel portion, the sole portion, and the toe portion, at least one material of dissimilar metallic material that differ from the metallic material and fiber reinforced plastic material is used in regions along edges that are adjacent to the face portion, within a range of 30 mm from the adjacent edges.

Further, the present invention may be adapted such that the at least two portions from among the crown portion, the heel portion, the sole portion, and the toe portion are divided into two portions along edges that are adjacent to the face portion, in regions within a range of 30 mm from the adjacent edges, each of the at least two portions having a first member that extends to the face portion, and a second member as a portion other than the first member, and joining portions are formed by joining members made from fiber reinforced plastics, the joining members overlapping the first member and the second member respectively to join.

Further, the present invention may be adapted such that the at least two portions from among the crown portion, the heel portion, the sole portion, and the toe portion are divided into two portions along edges that are adjacent to the face portion, in regions within a range of 30 mm from the adjacent edges, each of the at least two portions having a first member that extends to the face portion, and a second member made from fiber reinforced plastics, and joining portions are formed at which the second members overlap with and join to the first members.

Here, it is preferable the at least two portions from among the crown portion, the heel portion, the sole portion, and the toe portion have cutout portions within a range of 30 mm from edges that are adjacent to the face portion, along the adjacent edges, and at least one of the reinforced plastic material and the dissimilar metallic material be provided to close the cutout portions.

Further, it is preferable that at least one of the fiber reinforced plastic material and the dissimilar metallic material be provided while bonded with members around the cutout portions.

Further, it is preferable that the dissimilar metallic material be alloy material selected from the group consisting of titanium alloy, magnesium alloy, stainless steel alloy, and aluminum alloy.

Further, it is preferable that an elastic modulus of fibers of the fiber reinforced plastic materials be less than $27\times10^3$ kg-f/mm$^2$.

BEST MODES FOR CARRYING OUT THE INVENTION

A hollow golf club head of the present invention is explained below in detail based on preferred embodiments shown in the appended drawings.

First Embodiment

Figure 1A:
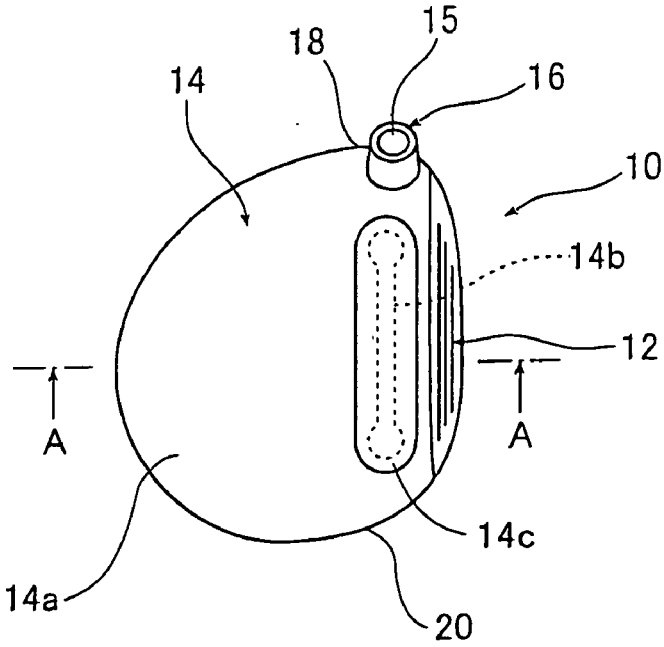
FIG. 1A is a front view schematically showing a hollow golf club head that is an embodiment of a hollow golf club head of the present invention.
Figure 1B:
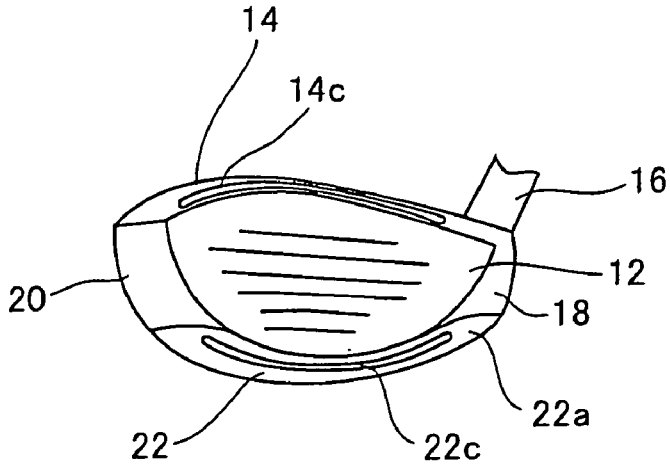
FIG. 1B is a side view of the golf club head shown in FIG. 1A as seen from a face portion side.
Figure 1C:
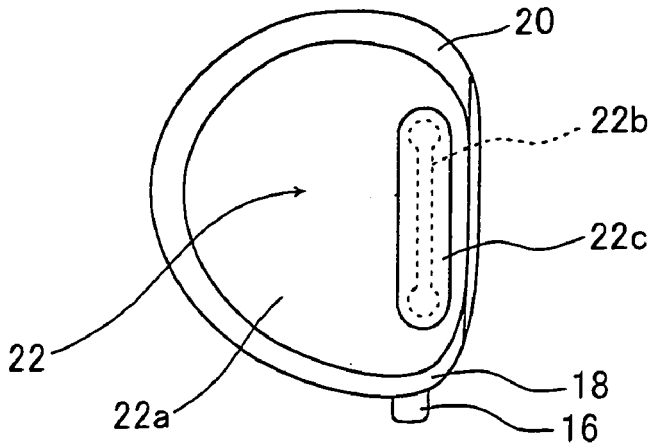
FIG. 1C is a bottom view of the golf club head shown in FIG. 1A as seen from a sole portion side.

FIG. 1A is a front view schematically showing a hollow golf club head (hereinafter referred to simply as a golf club head) 10 that is a first embodiment of a hollow golf club head of the present invention. FIG. 1B is a side view of the golf club head 10 as seen from a face portion side, and FIG. 1C is a bottom view of the golf club head 10 as seen from a sole portion side.

The golf club head 10 is configured having a face portion 12, in which an impact surface that strikes a golf ball is made from a metallic material, a crown portion 14 that forms an upper surface of the golf club head 10, a neck portion 16 that has a shaft insertion hole 15 into which a golf club shaft is inserted, a heel portion 18 that is a side portion connected along an edge of the crown portion 14 and is positioned on the neck portion 16 side, a toe portion 20 that is positioned on a side opposite to the neck portion 16 sandwiching the face portion 12, and a sole portion 22 which is connected along an edge of the heel portion 18 and the toe portion 20 and disposed opposite the crown portion 14, forming a bottom surface of the golf club head 10.

The crown portion 14, the heel portion 18, the toe portion 20, and the sole portion 22 are adjacent to the face portion 12.

A side portion is formed with the heel portion 18 and the toe portion 20 by at least one side member.

It should be noted that the face portion 12, the crown portion 14, the sole portion 22, and the side portion may be formed by manufacturing members corresponding to the respective portion and then bonding those members together into an integral structure through welding, by using an adhesive, or the like. Alternatively, members corresponding to at least two of the face portion 12, the crown portion 14, the sole portion 22, and the side portion may be manufactured integrally, and then those members may be bonded together through welding, by using an adhesive, or the like to form an integral structure. Furthermore, the crown portion 14 and the sole portion 22 may each be formed such that a portion of the corresponding member and remaining portions thereof are manufactured separately from each other and then bonded together through welding, by using an adhesive, or the like to form an integral structure.

In any case, there are no specific limitations placed on a method of manufacture of the gold club head 10.

The face portion 12, the heel portion 18, and the toe portion 20 are each configured by a metal alloy selected from the group consisting of titanium alloys, magnesium alloys, stainless steel alloys, and aluminum alloys.

The crown portion 14 is structured by: a crown main body member 14*a* which is configured by a metal alloy selected from the group consisting of titanium alloys, magnesium alloys, stainless steel alloys, and aluminum alloys, and has a slit-like cutout portion 14*b*, and a closing member 14*c* that engages with the slit-like cutout portion 14*b* and is bonded to the crown main body member 14*a* in the periphery of the cutout portion 14*b*, closing the cutout portion 14*b*.

Further, the sole portion 22 is structured by: a sole main body member 22*a* which is configured by a metal alloy selected from the group consisting of titanium alloys, magnesium alloys, stainless steel alloys, and aluminum alloys; and a closing member 22*c* which engages with a slit-like cutout portion 22*b* provided to the sole main body member 22*a* and which is bonded to the sole main body member 22*a* in the periphery of the cutout portion 22*b*.

It should be noted that both of the cutout portions 14*b* and 22*b* are adapted to have large cutout widths in both ends of the cutout portions 14*b* and 22*b* so that excess stress does not concentrate at the ends.

The closing members 14*c* and 22*c* are composite materials formed by laminating a plurality of layers of a fiber reinforced plastic material in which fibers are arranged in a predetermined direction. The fiber reinforced plastic material is formed by impregnating reinforcing fibers such as carbon fibers, glass fibers, or aramid fibers into a matrix resin such as an epoxy resin, an unsaturated polyester resin, or a vinyl ester resin. It should be noted that it is preferable that the reinforcing fibers have an elastic modulus that is less than $27\times10^3$ kg-f/mm$^2$.

Further, used for the closing members 14*c* and 22*c* are materials that have a lower flexural rigidity than that of the metallic material used in the face portion 12, preferably materials that have a lower Young's modulus than that of the metallic material used in the face portion 12. The term flexural rigidity as used herein means flexural rigidity in a condition that a flexure force is applied in an out-of-plane direction along a cut line of the crown portion taken along a plane perpendicular to the impact surface of the face portion.

Figure 2:
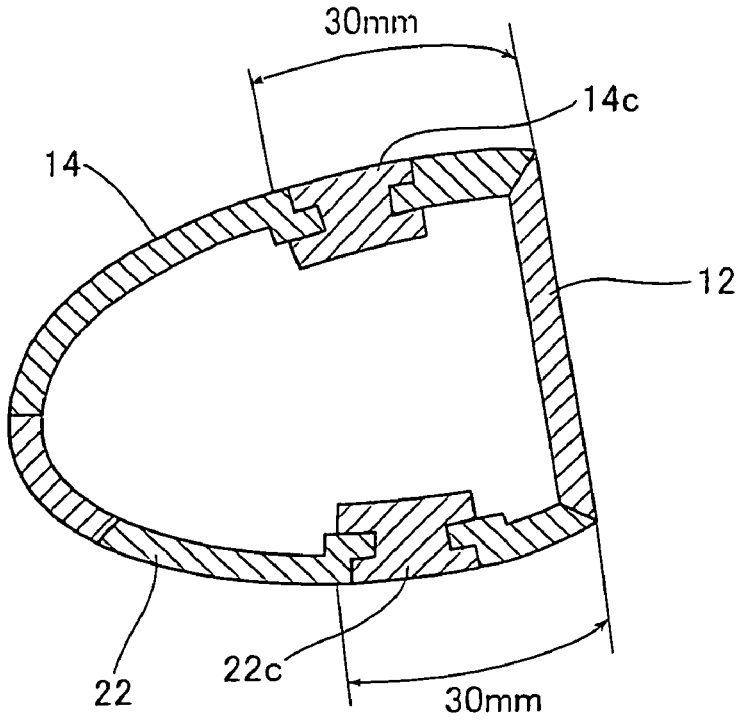
FIG. 2 is a cross sectional view of the golf club head taken along a line A-A of FIG. 1A as seen from the direction of arrows A.

FIG. 2 is a cross sectional view of the golf club head 10 taken along a line A-A of FIG. 1A as seen from the direction of arrows A.

The closing member 14*c* is disposed along an edge of the crown portion 14, adjacent to the face portion 12, in a region of the crown portion 14 within a range of 30 mm from the edge of the crown portion 14 which is adjacent to the face portion 12. The closing member 22*c* is disposed along an edge of the sole portion 22, adjacent to the face portion 12, in a region of the sole portion 22 that is within a range of 30 mm from the edge of the sole portion 22 which is adjacent to the face portion 12.

The closing members 14*c* and 22*c* are provided along the edges that are adjacent to the face portion 12, in the regions that are within 30 mm from the edges, because deformation during impact of the face portion 12 can be effectively made larger to increase the coefficient of restitution of a struck golf ball, thus increasing the carry distance of the golf ball. That is, by using this type of configuration, the coefficient of restitution of a golf ball can be increased, and the carry distance of the golf ball can be increased, without making the thickness of the face portion 12 thinner. This is shown in embodiments of the present invention described hereinafter. It should be noted that it is preferable to set the length of the closing member 14*c* that is disposed along the edge of the crown portion 14, adjacent to the face portion 12, to be from 20 to 50 mm in order to effectively demonstrate the effects described above.

It should also be noted that, although fiber reinforced plastic materials are used in the embodiment described above in the closing member 14*c* of the cutout portion 14*b* of the crown portion 14, and in the closing member 22*c* of the cutout portion 22*b* of the sole portion 22, dissimilar metallic materials that differ from the metallic material used in the face portion 12 may also be used as the closing members. In this case, a fiber reinforced plastic may also be used in one of the crown portion 14 and the sole portion 22, while a dissimilar metallic material is used in the other.

In this case as well, the dissimilar metallic material used is a material having a lower flexural rigidity than that of the metallic material used in the face portion 12, and preferably is a material having a lower Young's modulus.

For cases where metal having a single component is used, the term "dissimilar metallic material" means different type of component. In addition, when alloy is used, the term "dissimilar metallic material" means alloy where the sum of smaller composition ratios selected among two respective composition ratios of each shared component with the compared alloy is less than 20%. For example, when comparing a 6-4 titanium alloy (Ti:Al:V=90:6:4) and a 15-5-3 titanium alloy (Ti:Mo:Zr:Al=77:15:5:3), the sum of composition ratios described above becomes 80% (=77+3), and therefore the 6-4 titanium alloy and the 15-5-3 titanium alloy cannot be referred to as the dissimilar metallic materials. On the other hand, the 6-4 titanium alloy and a magnesium alloy having a magnesium composition ratio equal to or greater than 80% can be referred to as the dissimilar metallic materials.

Figure 3A:
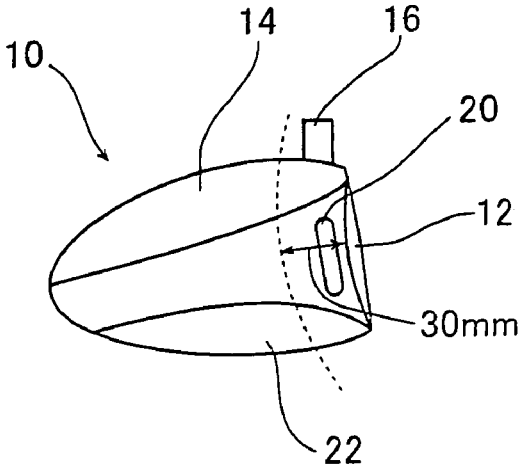
FIGS. 3A and 3B are diagrams for explaining where cutout portions are provided in a toe portion and a heel portion, respectively.
Figure 3B:
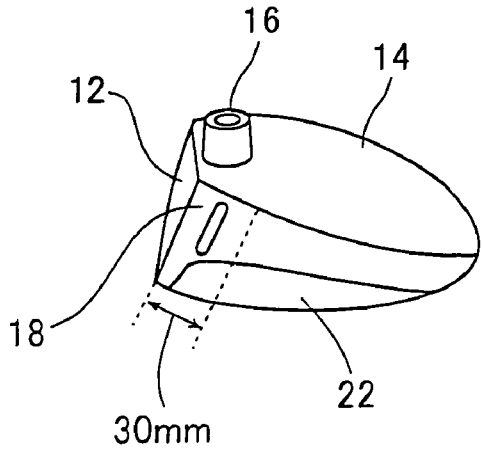

Furthermore, in addition to the crown portion 14 and the sole portion 22, cutout portions may also be formed in the heel portion 18 and the toe portion 20. Dissimilar metallic materials that differ from the metallic material used in the face portion 12, and the fiber reinforced plastic materials described above, may be used to close the cutout portions. In this case, as shown in FIGS. 3A and 3B, the cutout portions are formed adjacent to the face portion 12, in regions within a range of 30 mm from edges that are adjacent to the face portion 12, along contours of the toe portion 20 and the heel portion 18. Portions of the heel portion 18 and the toe portion 20 therefore have the cutout portions within a region that is 30 mm from the edges that are adjacent to the face portion 12, along the adjacent edges. Closing members are employed to close the cutout portions. In this case it is preferable that the length of the closing members disposed along the edges that are adjacent to the face portion 12 be set to 10 to 20 mm.

In the present invention, the fiber reinforced plastic material and the dissimilar metallic material that differs from the metallic material used in the face portion 12 are used in at least two portions from among the crown portion, the sole portion, the heel portion, and the toe portion.

It should be noted that the edge adjacent to the face portion 12 is a region whose radius of curvature is equal to or less than half of the radius of curvature in the vicinity of the center of the face portion 12, namely a portion where the radius of curvature changes substantially discontinuously.

The hollow golf club head of the present invention is thus one in which at least one material of fiber reinforced plastic material and dissimilar metallic material that differ from the metallic material used in the face portion, is used along an edge that is adjacent to the face portion of the golf club head, in a region within a range of 30 mm from the edge, in at least two portions from among the crown portion, the heel portion, the sole portion, and the toe portion of the golf club head. This provides a structure in which, in addition to the face portion, the at least two portions from among the crown portion the heel portion, the sole portion, and the toe portion easily deform with respect to golf ball impacts. The face portion thus deforms more than a conventional face portion. The coefficient of restitution of a struck golf ball can therefore increase, the initial velocity of the golf ball can increase, and the carry distance can increase.

There are no specific limitations placed on a method of providing the closing members 14*c* and 22*c* of the golf club head 10 in the embodiment described above, and any method may be used. For example, each of main body members such as a crown main body member and a sole member may be manufactured with two separate main body portion members having cutout portions in boundaries thereof. After disposing closing members in the position of the cutout portions formed by the two manufactured main body portion members, the closing members and the main body portion members in the periphery of the closing members may be bonded together by using an adhesive. The two main body portion members may also be bonded by using welding or an adhesive.

The carry distance of a golf ball was measured by using the hollow golf club head of the present invention, and effects of the present invention were investigated.

The golf club head shown in FIGS. 1A to 1C was manufactured as the hollow golf club head of the present invention. The golf club head was manufactured by using a laminated composite material made from a carbon fiber reinforced plastic material in the closing member 14*c* of the crown portion 14 and the closing member 22*c* of the sole portion 22, with a member made from the 15-5-3 titanium alloy employed in the face portion, and members made from the 6-4 titanium alloy in other members (Example 1).

Used for the carbon fiber reinforced plastic material were carbon fibers with an elastic modulus equal to or less than $27\times10^3$ kg-f/mm$^2$. It should be noted that the configuration of the composite material is one having a four layer structure in which four layers are laminated alternately at an orientation angle of ±45°. The term "orientation angle" as used here means an orientation direction of the carbon fibers, taking a golf ball striking direction as a reference direction.

In addition, a golf club was manufactured by forming cutout portions in the crown portion 14, the heel portion 18, the toe portion 20, and the heel portion 22 along edges that are adjacent to the face portion 12, in regions within a range of 30 mm from the edges. Composite materials similar to those of Example 1 were used as closing members for the cutout portions, and the same titanium alloy as that used in Example 1 was used in other portions (Example 2).

Further, a golf club head was manufactured by using a magnesium alloy which has a composition ratio for magnesium equal to or greater than 80% for the closing member 14*c* of the crown portion 14 and the closing member 22*c* of the sole portion 22 of FIGS. 1A to 1C. The same titanium alloy as that used in Example 1 was used in other members (Example3). The magnesium alloy is used as dissimilar metallic material with respect to the titanium alloy.

In addition, a golf club was manufactured by forming cutout portions in the crown portion 14, the heel portion 18, the toe portion 20, and the heel portion 22 along edges that are adjacent to the face portion 12, in regions within a range of 30 mm from the edges. A magnesium alloy similar to that of Example 3 was used as closing members for the cutout portions, and the same titanium alloy as that used in Example 1 was used in other portions (Example 4).

It should be noted that the flexure rigidity for the closing members is made lower than the flexural rigidity of the face portion in Embodiments 1 to 4.

Furthermore, a hollow golf club head made from a single alloy configured by a titanium alloy similar to that used in Examples 1 to 4 was also manufactured as a comparative example.

Golf clubs were manufactured by attaching golf club shafts to the manufactured golf club heads, and in addition, providing grip portions to the golf club shafts.

Measurement of the carry distance was performed by test hitting golf balls with the manufactured golf clubs swung by a Miya Shot Robo IV made by Miyamae Co., Ltd., under conditions of a head speed of 40 m/s.

The carry distances were collected as indexes taking the carry distance of the comparative example as 100, and results shown in Table 1 below were obtained. It should be noted that a higher index shows golf ball carry distance longer.

The notation "FRP" in Table 1 below means a carbon fiber reinforced plastic material.

TABLE 1

| | Closing member position | Closing member | Carry distance |
|---|---|---|---|
| Example 1 | Crown portion, sole portion | FRP | 107 |
| Example 2 | Crown portion, sole portion, heel portion, toe portion | FRP | 112 |
| Example 3 | Crown portion, sole portion | Magnesium alloy | 105 |
| Example 4 | Crown portion, sole portion, heel portion, toe portion | Magnesium alloy | 110 |
| Comparative Example | — | — | 100 |

It can be understood from Table 1 above that the carry distances for all of the golf clubs that use the golf club heads of Examples 1 to 4 are longer than the carry distance of the Comparative Example.

Second Embodiment

Figure 4A:
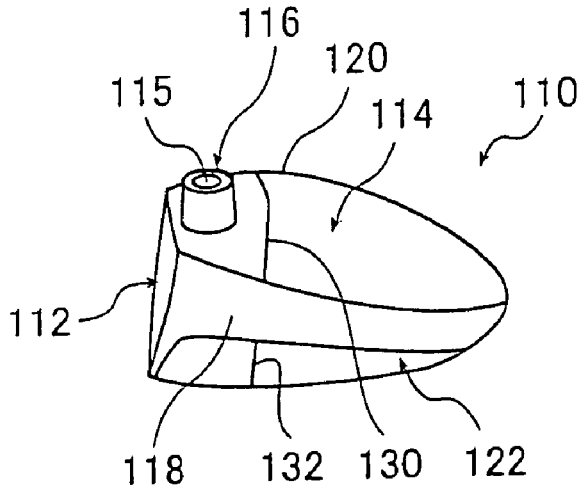
FIG. 4A is a side view of a hollow golf club head that is an embodiment of a hollow golf club head of the present invention as seen from a heel side.
Figure 4B:
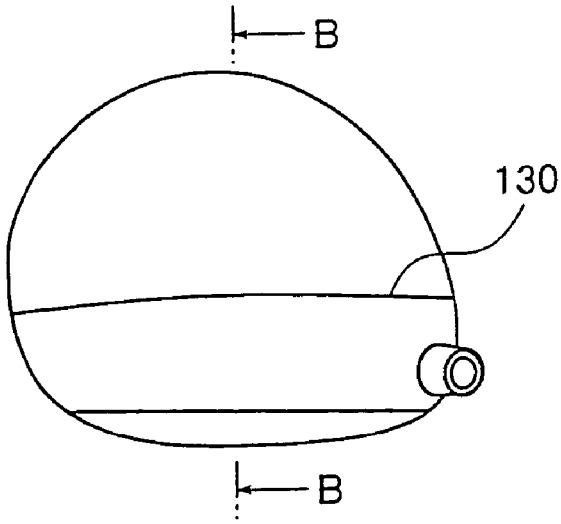
FIG. 4B is a top view of the golf club head shown in FIG. 4A as seen from a crown side.
Figure 4C:
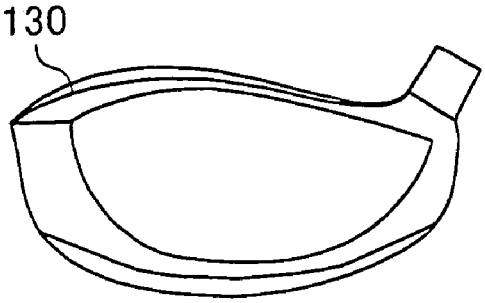
FIG. 4C is a front view of the golf club head shown in FIG. 4A as seen from a face side.

FIG. 4A is a side view, as seen from a heel side, that shows a schematic of a hollow golf club head (hereinafter referred to simply as a golf club head 110) according to a second embodiment of a hollow golf club head of the present invention. FIG. 4B is a top view of the golf club head 110 shown in FIG. 4A as seen from a crown side, and FIG. 4C is a front view of the golf club head 110 shown in FIG. 4A as seen from a face side.

The golf club head 110 is configured by a face portion 112 having an impact surface for striking a golf ball and which is made from a metallic material, a crown portion 114 that forms an upper surface of the golf club head 110, a neck portion 116 that has a shaft insertion hole 115 into which a golf club shaft is inserted, a heel portion 118 that is a side portion connected along an edge of the crown portion 114 and is positioned on the neck portion 116 side, a toe portion 120 that is positioned on a side opposite that of the neck portion 116, sandwiching the face portion 112, and a sole portion 122 that is connected along an edge of the heel portion 118 and the toe portion 120, and is disposed opposite the crown portion 114, forming a bottom surface of the golf club head 110.

The heel portion 118, the toe portion 120, the sole portion 122, and the crown portion 114 are adjacent to the face portion 112.

A side portion is formed for the heel portion 118 and the toe portion 120 by at least one side member. The face portion 112, the heel portion 118, and the toe portion 120 are made from titanium alloys, but may also be made from alloys selected from the group consisting of titanium alloys, magnesium alloys, stainless steel alloys, and aluminum alloys.

The crown portion 114 and the sole portion 122 are made from titanium alloys, and may also be made from alloy materials selected from the group consisting of titanium alloys, magnesium alloys, stainless steel alloys, and aluminum alloys, or fiber reinforced plastic materials (FRPs).

At least two portions from among the crown portion, the heel portion, the sole portion, and the toe portion are each divided into face sides and back sides.

In this embodiment, the crown portion and the sole portion are selected as the two portions. As shown in FIG. 4, a joining line 130 made from a resin is taken as a boundary, thus dividing the crown portion 114 into a face side crown portion and a back side crown portion. A joining line 132 is taken as a boundary, thus dividing the sole portion into a face side sole portion and a back side sole portion. The joining lines 130 and 132 are positioned along edges that are adjacent to the face portion 112, and within a range of 30 mm from the adjacent edges. It should be noted that the whole joining lines 130 and 132 do not need to be disposed along the edges adjoining the face portion 112, and contained within a range of 30 mm from the adjoining edges. The total length of the joining lines existing in at least two portions should be equal to or greater than 40 mm.

Figure 5A:
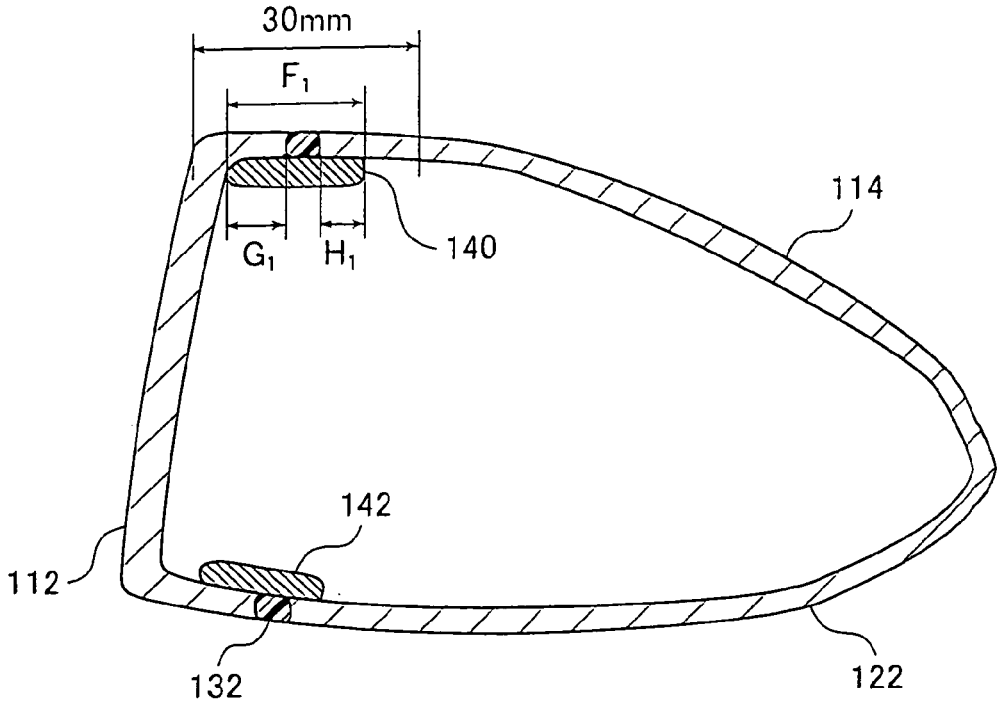
FIG. 5 is a cross sectional view of the golf club head taken along a line B-B of FIG. 4B as seen from the direction of arrows B.
Figure 5B:
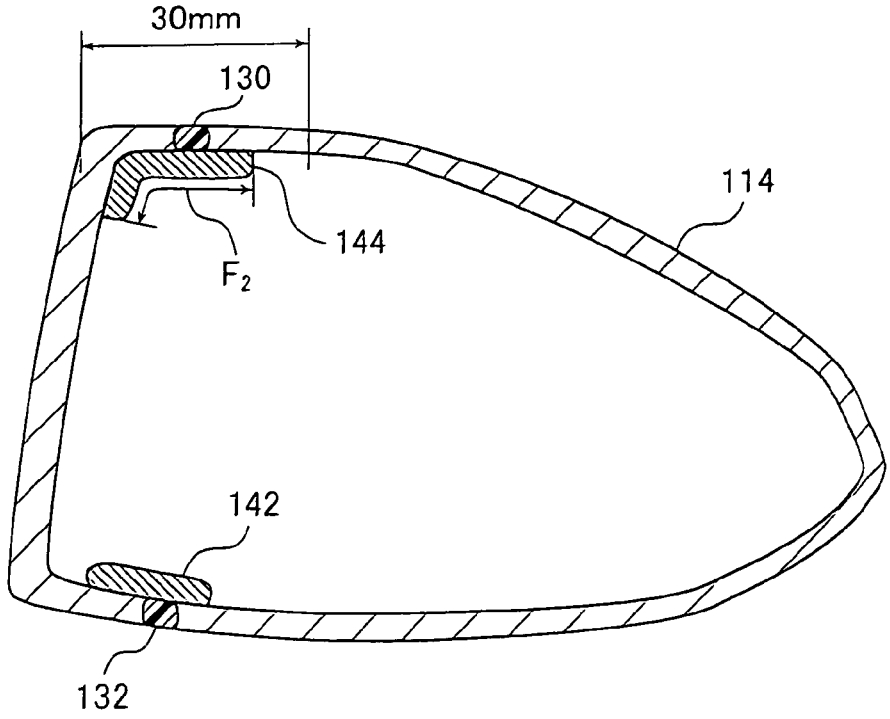

The members used in the crown portion 114 and in the sole portion 122, which are each divided into two portions along the joining lines, are bonded by an adhesive to joining portions 140 (or 144) and 142, respectively, shown in FIG. 5A (or FIG. 5B). The face side and the back side are thus integrated. The joining portions are configured by carbon fiber reinforced plastic materials in which carbon fibers are impregnated in a matrix resin as reinforcing fibers. It should be noted that the joining portions may also be configured by using fiber reinforced plastic materials in which reinforcing fibers such as carbon fibers, glass fibers, or aramid fibers are impregnated into a matrix resin such as an epoxy resin, an unsaturated polyester resin, or a vinyl ester resin.

In this embodiment, the crown portion and the sole portion are each divided into two portions, and the divided members are integrated through the joining portions. Accordingly, the golf club head 110 becomes a structure that easily deforms with respect to golf ball impacts. The face portion therefore deforms more than a conventional face portion. The coefficient of restitution of a struck golf ball can be increased, the initial velocity of the golf ball can be increased, and the carry distance can be increased.

FIG. 5A is a cross sectional view of the golf club head 110 taken along a line B-B as seen from the direction of arrows B shown in FIG. 4B.

Among the crown portion and the sole portion that are each divided into two portions, a member that configures the face side is referred to as the face side member 112, and members that configure the back side are referred to as the back side-members 114 and 122. In the embodiment shown in FIGS. 5A and 5B, both the face side member and the back side members are configured by titanium alloys, separated along the joining lines 130 and 132. The joining lines are resins embedded in gaps between the face side member and sole side members. However, the joining lines are not limited to this configuration, and may also be embedded in fiber reinforced plastic material (FRP) for example. Furthermore, the width of the gaps is set to 1 mm. The gaps are provided in order to make a structure that easily deforms with respect to golf ball impacts, and their width may be suitably set.

The joining portions 140 and 142 are each configured by one joining material, and are each made from a carbon fiber reinforced plastic. The length of the joining portion 140 is taken as $F_1$, the length of a portion that bonds to the face side crown portion is taken as $G_1$, and the length of a portion that bonds to the back side crown portion is taken as $H_1$. The entire length $F_1$ of the joining portion may be from 15 mm to 80 mm. Further, the length $G_1$ of the face side joining portion is preferably from 8 mm to30 mm, more preferably from 12 mm to 20 mm. The length $H_1$ of the back side joining portion is preferably from 5 mm to 40 mm, more preferably from 5 mm to 30 mm, and additionally preferably from 5 mm to 20 mm.

It should be noted that the entire length and the joining lengths of the joining portion 142 are repectivle similar to those of the joining portion 140.

FIG. 5B is a cross sectional view of the golf club head 110 taken along the line B-B as seen from the direction of the arrows B shown in FIG. 4B, and shows a variation of the joining portion 140. With FIG. 5B, a portion of the joining portion 144 that is bonded to the face side is curved and bonded to the face portion 112. The joining portion of the face side thus contacts not only the crown portion, but also the face portion. The joining portion 142 may also similarly contact the face portion. However, in this case as well, an entire length $F_2$ of the joining portion is from 15 mm to 80 mm, preferably from 5 to 20 mm.

Third Embodiment

Figure 6A:
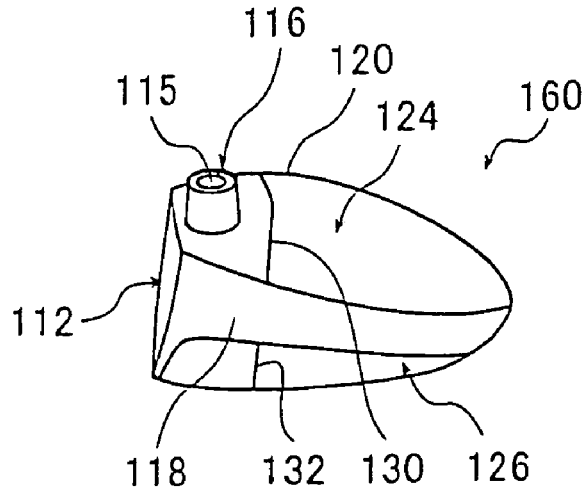
FIG. 6A is a side view of a hollow golf club head that is an embodiment of a hollow golf club head of the present invention as seen from a heel side.
Figure 6B:
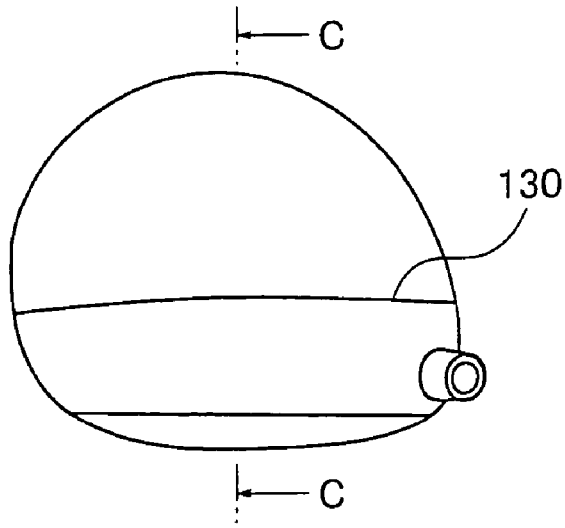
FIG. 6B is an upper surface view of the golf club head shown in FIG. 6A as seen from a crown side.
Figure 6C:
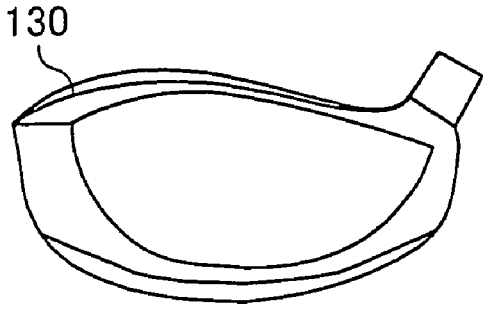
FIG. 6C is a front view of the golf club head shown in FIG. 6A as seen from a face side.

FIG. 6A is a side view, as seen from a heel side, that shows a schematic of a hollow golf club head (hereinafter referred to simply as a golf club head 160) that is a third embodiment of a hollow golf club head of the present invention. FIG. 6B is a top view of the golf club head shown in FIG. 6A as seen from a crown side, and FIG. 6C is a front view of the golf club head shown in FIG. 6A as seen from a face side.

In the second embodiment the same metallic material (titanium alloy) is used in the crown portion 114 and the sole portion 122 as that used in the face portion 112. In the third embodiment, however, dissimilar metallic materials that differ from the material used in the face portion are used. It should be noted that portions that are the same as those of the second embodiment mode use the same appended reference numerals, and explanations thereof are omitted.

For cases where metal having a single component is used, the term "dissimilar metallic material" means different type of component. In addition, when alloy is used, the term "dissimilar metallic material" means alloy where the sum of smaller composition ratios selected among two respective composition ratios of each shared component with the compared alloy is less than 20%.

The hollow golf club head of the present invention is configured so that at least two portions from among a crown portion 124, the heel portion 118, a sole portion 126, and the toe portion 120 are divided into two portions at a region along edges that are adjacent to the face portion, within a range of 30 mm from the adjacent edges, each having a first member that extends to the face portion 112 and another second member.

In this embodiment, the crown portion 124 and the sole portion 126 are selected as the portions divided in two. As shown in FIG. 7, the crown portion 124 is divided into a face side crown portion and a back side crown portion, with the joining line 130 made from a resin as a boundary, and the sole portion 126 is divided into a face side sole portion and a back side sole portion with the joining line 132 made from a resin as a boundary.

Figure 7A:
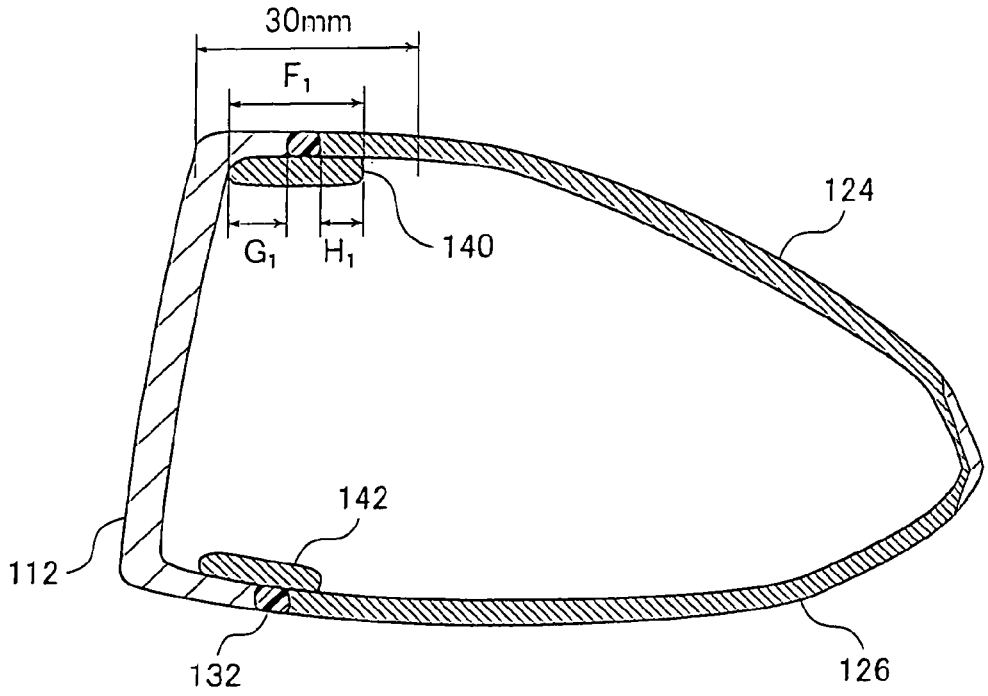
FIG. 7 is a cross sectional view of the golf club head taken along a line C-C of FIG. 6B as seen from the direction of arrows C.
Figure 7B:
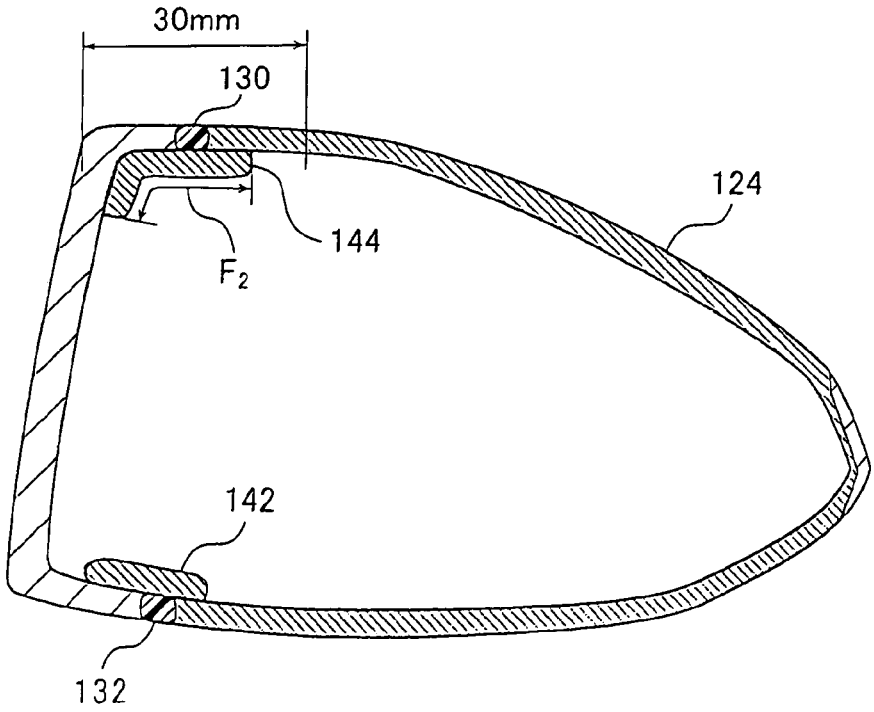

In addition, joining portions are formed as shown in FIGS. 7A and 7B by the joining members 140 (or 144) and 142 that overlap with the first member and the second member to join. The joining members are made from fiber reinforced plastics. The hollow golf club head of the present invention thus has a structure that easily deforms with respect to golf ball impacts. There is more deformation than with a conventional face portion, and therefore the coefficient of restitution of a struck golf ball can be increased, the initial velocity of the golf ball can be increased, and the carry distance can be increased.

FIG. 7A is a cross sectional view of the golf club head shown in FIG. 6B taken along a line C-C as seen from the direction of arrows C. With the golf club head 110 shown in FIG. 5A, the joining portion is configured by one joining member, but with the golf club head 160 shown in FIG. 7A, the joining portion 140 is configured as a portion of the back side member 124, and is made from a carbon fiber reinforced plastic.

FIG. 7B is a cross sectional view of the golf club head shown in FIG. 7A taken along a line C-C as seen from the direction of arrows C, and is an alternative example of the joining portion 140. In FIG. 7B, a portion of the joining portion 144 that is bonded to the face side is bent and is bonded to the face portion. The joining portion of the face side thus may also be joined to the face portion, not only the crown portion. However, in this example as well the entire length $F_2$ of the joining portion is from 15 to 80 mm. Further, the joining portion 142 may also similarly contact the face portion.

The hollow golf club head of the present invention is one in which at least two portions from among the crown portion, the heel portion, the sole portion, and the toe portion are respectively divided into two regions along edges that are adjacent to the face portion, within a range of 30 mm from the adjacent edges, each having the first member that extends to the face portion, and the second member made from a fiber reinforced plastic. In addition, the second members of the hollow golf club are overlapping with the first members to join to, forming the joining portions. The hollow golf club head of the present invention therefore has a structure that easily deforms with respect to golf ball impacts. The face portions deforms more than a conventional face portion, and therefore the coefficient of restitution of a struck golf ball can be increased, the initial velocity of the golf ball can be increased, and the carry distance can be increased.

Effects of the present invention were investigated by measuring durability and restitution characteristics using the hollow golf club head of the present invention.

The golf club heads shown in FIGS. 4A to 4C were manufactured as the hollow golf club heads of the present invention.

The crown portion and the sole portion were selected as divided portions as shown in FIGS. 4A to 4C, and a titanium alloy (Ti alloy) was used in the first member and the second member of the crown portion and the sole portion, as shown in FIG. 5A. The titanium alloy used was composed of 15% V by weight, 3% Cr by weight, 3% Al by weight, 3% Sn by weight, with Ti in the remainder. Further, gaps between the first members and the second members were filled and closed by using a resin.

Figure 8:
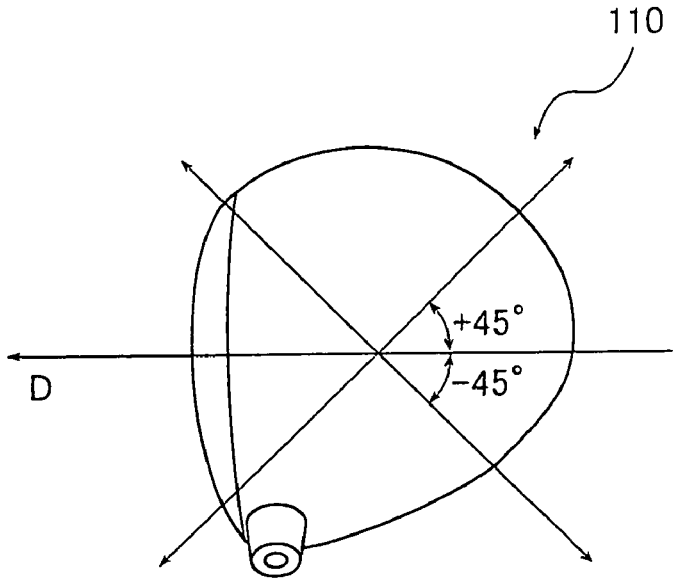
FIG. 8 is an explanatory diagram for explaining an orientation angle of a laminate composite material.

A composite material including a laminated carbon fiber reinforced plastic material (CFRP) was used in the joining portions. The carbon fiber reinforced plastic material was one in which the carbon fibers had an elastic modulus of $24\times10^3$ kg-f/mm$^2$, a fiber density of 160 g/m$^2$, and a resin content of 38%. It should be noted that the composite material had a six layer configuration in which layers were laminated alternately at an orientation angle of ±45°. The term "orientation angle" as used here means the orientation direction of the carbon fibers, taking a golf ball strike direction D as a reference direction as shown in FIG. 8.

Members made from a 15-5-3 titanium alloy were used as the face members.

Figure 9:
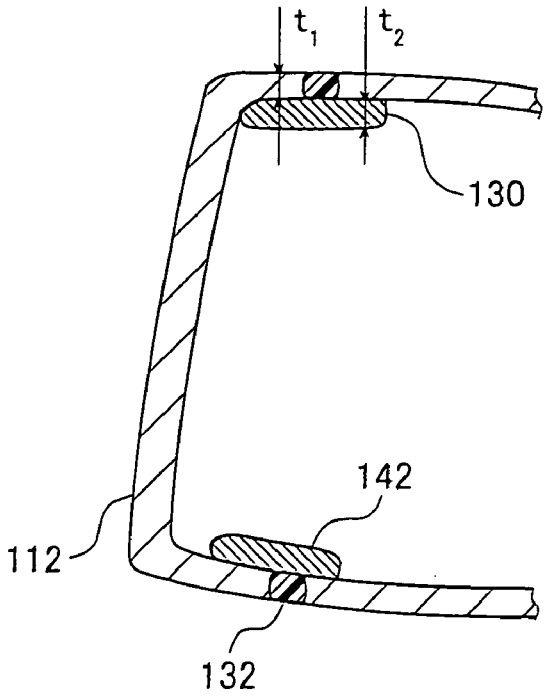
FIG. 9 is an explanatory diagram for explaining the thickness of the golf club head shown in FIG. 4.

In addition, as shown in FIG. 9, the thickness of the first members of the crown portion and the sole portion was taken as $t_1$, and the thickness of joining members made from the carbon fiber reinforced plastic material in the joining portions was taken as $t_2$. As shown in FIG. 5A, the length of the face side joining portion was taken as G, and the length of the back side joining portion was taken as H. These parameters were set as shown in Table 2 below, and Experimental Examples 1 to 20 were manufactured. It should be noted that, in the present invention, it is preferable that the thickness $t_1$ be set to 0.5 to 2.0 mm, and that the thickness $t_2$ be set to 0.5 to 1.5 mm. It is more preferable that the thickness $t_1$ be set to 0.8 to 1.8 mm, and that the thickness $t_2$ be set to 0.8 to 1.2 mm.

The thickness $t_1$ of the first members, the thickness $t_2$ of the joining members made from carbon fiber reinforced plastic material, the length G of the face side joining portion, and the length H of the back side joining portion may be limited within a range of ±20% from the center of the face width in the toe to heel direction in any cross section thereof, taking the face width as 100%. In defining the face width, an end portion of the toe is defined as a location that projects furthest out toward the toe side under a normal address position of the golf club head. An end portion of the heel is defined as a location that is 16 mm above the ground surface under the normal address position. It is preferable that the cross section be perpendicular with respect to the surface of the face portion and the ground surface.

Establishing the term "the normal address position" as used here means to place the golf club head 1 according to its lie angle, and set the center axis of the golf club shaft and the leading edge of the face portion of the golf club head to be parallel with each other as seen from vertically above the ground surface, that is, so that the face angle becomes zero degrees. The term "set according to lie angle" means to place the golf club head 1 so that gaps between the round surface of the sole portion that forms a bottom surface of the golf club head and the ground surface are substantially equal at the toe side and the heel side. For cases where the round surface of the sole portion is unclear, the golf club head 1 may also be set so that scorelines formed in the surface of the face portion become parallel with the ground surface. Further, for cases where the round surface of the sole portion is unclear and where it is difficult to determine whether or not the score lines are parallel with the reference surface due to the score lines not being straight or the like, the lie angle may be set so that the lie angle (degrees)=(100−club length (inches)). For example, when a golf club length is 44 inches, the lie angle may be set to 100−44=56°.

The club length is measured here by a measurement method specified by the Japan Golf Gear Association. A club measurer II manufactured by Kamoshita Seikoujyo K.K. can be given as a measurement unit.

Taking Experimental Example 1 as a conventional example, neither the crown portion nor the sole portion was divided in the conventional example, and only a titanium alloy was used. The thickness of the crown portion and the sole portion was 1.7 mm. In Experimental Examples 2 to 11, the thickness $t_1$ of the first members and the thickness $t_2$ of the joining portions were changed while holding the lengths G and H of the joining portions constant. In Experimental Examples 12 to 20, the lengths G and H of the joining portions were changed while holding the thickness $t_1$ of the first members and the thickness $t_2$ of the joining portions constant.

Golf clubs were manufactured by attaching a golf club shaft model TRX-DUO M40 (product name) manufactured by Yokohama Rubber Co., Ltd. to the manufactured golf club heads, and the experiments shown below were performed. The length of the golf clubs were each set to 45 inches.

Further, TRX (product name) balls manufactured by Yokohama Rubber Co. were used as golf balls in each of the experiments.

For durability, golf balls were impacted to a center portion of the face portion of each of the golf club heads of the experimental examples at velocity of 50 m/sec by using an air cannon tester, and the number of ball strikes up to failure was measured. In this case, the strength of each of the embodiments is expressed as an index, taking the number of ball strikes up to failure of the conventional example (embodiment 1) as 100.

For the restitution characteristics, evaluation was performed by using a coefficient of restitution for each embodiment measured based on the "Procedure for Measuring the Velocity Ratio of a Club Head for Conformance to Rule 4-1e, Appendix II Revision 2 Feb. 8, 1999" prescribed by the USGA (United States Golf Association). In this case, the restitution of each of the embodiments is expressed as an index, taking the coefficient of restitution of the conventional example as 100.

The point totals in Table 2 below are values found by adding indexes of the durability and the restitution characteristics together. The point total for the conventional example (Experimental Example 1) becomes 200, and becomes larger the better the durability and the restitution characteristics become.

TABLE 2

| | $t_1$ thickness (mm) | $t_1$ material | $t_2$ thickness (mm) | $t_2$ material | G (mm) | H (mm) | Durability | Restitution | Point total |
|---|---|---|---|---|---|---|---|---|---|
| Experimental Example 1 | 1.7 | Ti alloy | — | — | — | — | 100 | 100 | 200 |
| Experimental Example 2 | 1.5 | Ti alloy | 0.6 | CFRP | 15 | 10 | 152 | 106 | 258 |
| Experimental Example 3 | 1.2 | Ti alloy | 0.8 | CFRP | 15 | 10 | 152 | 110 | 262 |
| Experimental Example 4 | 1.0 | Ti alloy | 1.0 | CFRP | 15 | 10 | 150 | 113 | 263 |
| Experimental Example 5 | 0.7 | Ti alloy | 1.2 | CFRP | 15 | 10 | 145 | 113 | 258 |
| Experimental Example 6 | 0.3 | Ti alloy | 1.4 | CFRP | 15 | 10 | 135 | 115 | 250 |
| Experimental Example 7 | 2.2 | Ti alloy | 0.5 | CFRP | 15 | 10 | 156 | 93 | 249 |
| Experimental Example 8 | 1.8 | Ti alloy | 0.3 | CFRP | 15 | 10 | 150 | 99 | 249 |
| Experimental Example 9 | 0.7 | Ti alloy | 1.8 | CFRP | 15 | 10 | 153 | 97 | 250 |
| Experimental Example 10 | 2.2 | Ti alloy | 0.3 | CFRP | 15 | 10 | 152 | 93 | 245 |
| Experimental Example 11 | 0.3 | Ti alloy | 2.0 | CFRP | 15 | 10 | 147 | 98 | 245 |

TABLE 2-continued

| | $t_1$ thickness (mm) | $t_1$ material | $t_2$ thickness (mm) | $t_2$ material | G (mm) | H (mm) | Durability | Restitution | Point total |
|---|---|---|---|---|---|---|---|---|---|
| Experimental Example 12 | 1.2 | Ti alloy | 0.8 | CFRP | 5 | 10 | 116 | 121 | 237 |
| Experimental Example 13 | 1.2 | Ti alloy | 0.8 | CFRP | 15 | 2 | 124 | 115 | 239 |
| Experimental Example 14 | 1.2 | Ti alloy | 0.8 | CFRP | 5 | 2 | 92 | 140 | 232 |
| Experimental Example 15 | 1.2 | Ti alloy | 0.8 | CFRP | 36 | 10 | 156 | 82 | 238 |
| Experimental Example 16 | 1.2 | Ti alloy | 0.8 | CFRP | 15 | 25 | 155 | 86 | 241 |
| Experimental Example 17 | 1.2 | Ti alloy | 0.8 | CFRP | 36 | 25 | 161 | 74 | 235 |
| Experimental Example 18 | 1.2 | Ti alloy | 0.8 | CFRP | 10 | 25 | 140 | 98 | 238 |
| Experimental Example 19 | 1.2 | Ti alloy | 0.8 | CFRP | 18 | 10 | 153 | 106 | 259 |
| Experimental Example 20 | 1.2 | Ti alloy | 0.8 | CFRP | 25 | 10 | 154 | 97 | 251 |

As can be understood from Experimental Examples 2 to 11 shown in Table 2, each of the Experimental Examples 2 to 11 has a larger point total than the conventional example (Experimental Example 1). In particular, the point total for Experimental Examples 2 to 5 is large, and in addition it can be understood that the point totals of Experimental Examples 3 and 4 are largest.

It can therefore be said that it is preferable that the thickness $t_1$ be from 0.5 to 2.0 mm and the thickness $t_2$ be from 0.5 to 1.5 mm, and that it is more preferable that the thickness $t_1$ be from 0.8 to 1.8 mm and the thickness $t_2$ be from 0.8 to 1.2 mm.

Further, comparing Experimental Examples 12 to 20 shown in Table 2 with Experimental Example 3, which has the identical thickness $t_1$ and the identical thickness $t_2$, the point totals for Experimental Examples 13 and 16, in which the length G of the joining portion is equal to or greater than 8 mm, are larger than the point total for Experimental Example 14, in which the length G is equal to or less than 8 mm and the length H of the joining portion is equal to or less than 5 mm. The point totals for Experimental Examples 12 and 15, in which the length H is equal to or greater than 5 mm, are larger than the point total for Experimental Example 14, in which the length G is equal to or less than 8 mm and the length H is equal to or less than 5 mm. The point total for Experimental Example 3, in which the length G is equal to or less than 20 mm, is larger than the point total of Experimental Example 20, in which the length G is equal to or greater than 20 mm. The point total for Experimental Example 3, in which the length H is equal to or less than 20 mm, is greater than the point total for Experimental Example 16, in which the length H is equal to or greater than 20 mm.

It is preferable that the length of G be from 8 mm to 30 mm, and more preferably from 12 to 20 mm.

It is preferable that the length H be from 5 mm to 40 mm, more preferably from 5 mm to 30 mm, and even more preferably from 5 mm to 20 mm.

Fourth Embodiment

Figure 10A:
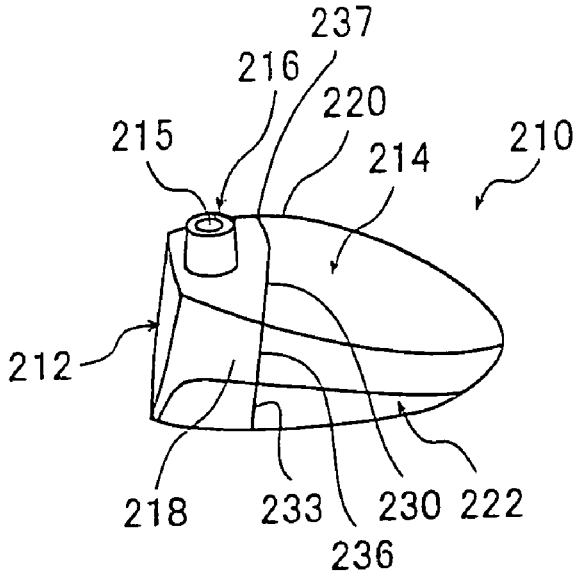
FIG. 10A is a side view of a hollow golf club head that is an embodiment of a hollow golf club head of the present invention as seen from a heel side.
Figure 10B:
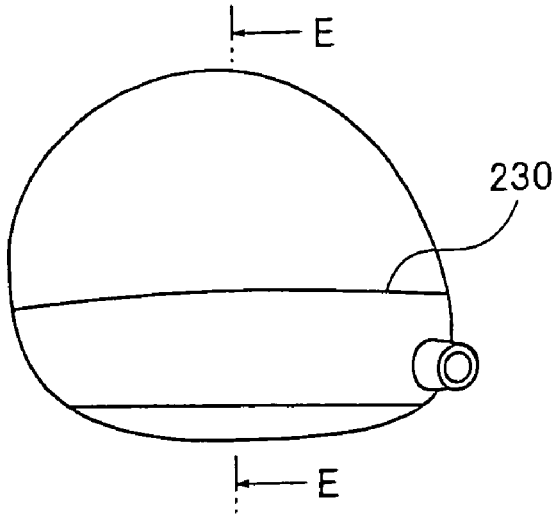
FIG. 10B is a top view of the golf club head shown in FIG. 10A as seen from a crown side.
Figure 10C:
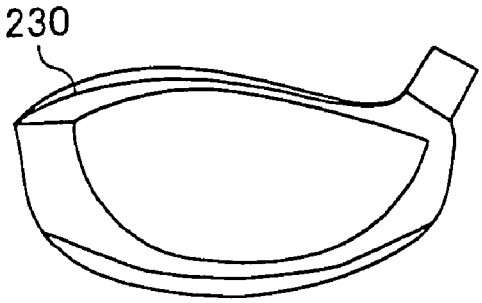
FIG. 10C is a front view of the golf club head shown in FIG. 10A as seen from a face side.

FIG. 10A is a side view of a hollow golf club head of the present invention (hereinafter referred to simply as a golf club head 210) as seen from a heel side, FIG. 10B is an upper surface view of the golf club head shown in FIG. 10A as seen from a crown side, and FIG. 10C is a front view of the golf club head shown in FIG. 10A as seen from a face side.

The golf club head 210 is configured to include a face portion 212, in which an impact surface that impacts a golf ball is made from a metallic material, a crown portion 214 that forms an upper surface of the golf club head 210, a neck portion 216 that has a shaft insertion hole 215 into which a golf club shaft is inserted, a heel portion 218 that is a side portion connected along an edge of the crown portion 214 and is disposed on the neck portion 216 side, a toe portion 220 that is disposed on a side opposite the neck portion 216, sandwiching the face portion 212, and a sole portion 222 that is connected along edges of the heel portion 218 and the toe portion 220, forming a bottom surface of the golf club head 210 disposed opposing the crown portion 214.

The heel portion 218, the toe portion 220, the sole portion 222, and the crown portion 214 are adjacent to the face portion 212.

The heel portion 218 and the toe portion 220 form a side portion here by at least one side member. The face portion 212, the heel portion 218, and the toe portion 220 are made from a titanium alloy, but may also be configured from an alloy selected from the group consisting of titanium alloys, magnesium alloys, stainless steel alloys, and aluminum alloys.

Portions of the crown portion 214 and the sole portion 222 are made from titanium alloys, but may also be configured from an alloy material selected from the group consisting of titanium alloys, magnesium alloys, stainles ssteel alloys, and aluminum alloys, or from a fiber reinforced plastic (FRP).

In this embodiment mode, the crown portion, the sole portion, and the side portion (the heel portion 218 and the toe portion 220) are selected as at least two portions of the claimed invention. As shown in FIG. 10, the crown portion is divided into a face side crown portion and a back side crown portion, one edge of the face side crown portion being adjacent to the face portion 212, with another edge 230 within a range of 30 mm from the one edge adjacent to the face portion 212. The sole portion is also divided into a face side and a back side, similar to the crown portion, with one edge adjacent to the face surface, and another edge 233 within a range of 30 mm from the one edge adjacent to the face surface. The side portion made from the heel portion 218 and the toe portion 220 is also similarly divided into a face side and a back side, with one edge of each adjacent to the face portion 212, and other edges 236 and 237 within a range of 30 mm from the one edges.

Figure 11A:
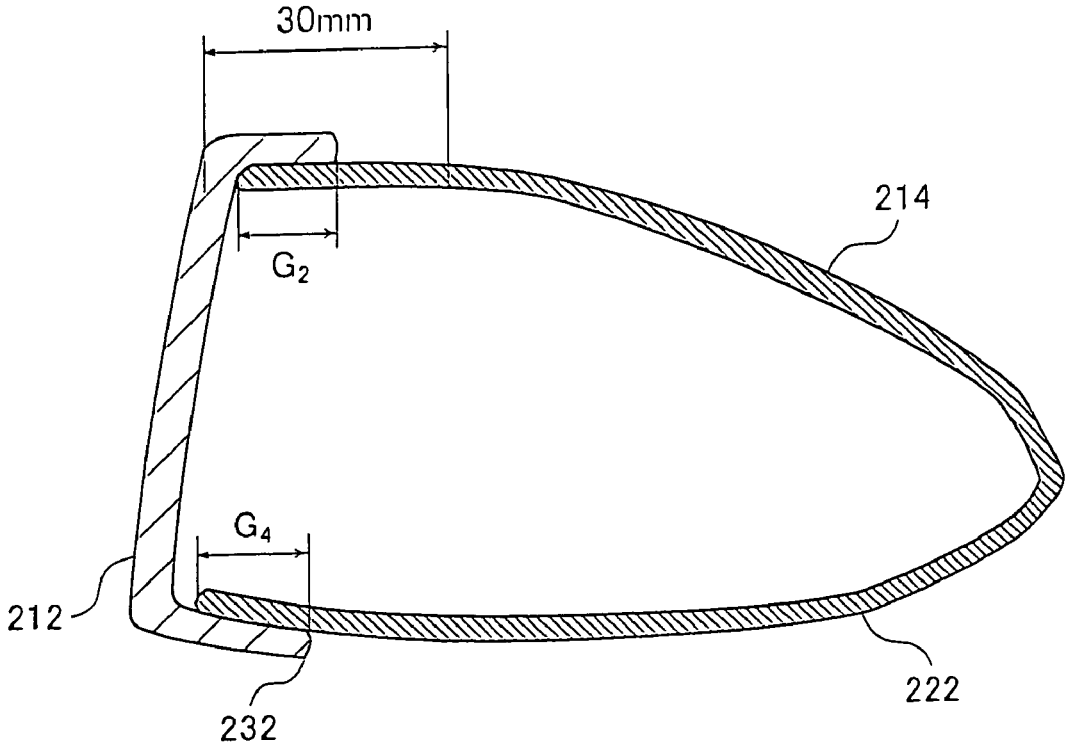
FIG. 11 is a cross sectional view of the golf club head taken along a line E-E of FIG. 10B as seen from the direction of arrows E.

FIG. 11A is a cross sectional view of the golf club head shown in FIG. 10B taken along a line E-E as seen from the direction of arrows E.

The face side crown portion and the back side crown portion are joined mutually overlapping, and the face side sole portion and the back side sole portion are joined mutually overlapping. In addition, the face side heel portion and the back side heel portion are joined mutually overlapping, and the face side toe portion and the back side toe portion are similarly joined mutually overlapping.

It is preferable that a joining portion length $G_2$ shown in FIG. 11A be set from 8 mm to 30 mm, more preferably from 12 mm to 20 mm.

In this embodiment, the face side crown portion is configured by the same titanium alloy as that of the face portion, but may also be configured by an alloy material chosen from the group consisting of titanium alloys, magnesium alloys, stainless steel alloys, and aluminum alloys. Further, the back side crown portion is configured by a carbon fiber reinforced plastic, but may also be configured by a fiber reinforced plastic material in which reinforcing fibers such as carbon fibers, glass fibers, or aramid fibers are impregnated in a matrix resin such as an epoxy resin, an unsaturated polyester resin, or a vinyl ester resin. It should be noted that the sole portion and the side portion (toe portion and heel portion) are similar.

The face side crown portion and the back side crown portion, the face side sole portion and the back side sole portion, and the face-side side portion (the toe portion and the heel portion) and the sole-side side portion (the toe portion and the heel portion) are mutually bonded by an adhesive or a resin film, respectively. Epoxies, urethanes, acrylics, and cyanoacrylate resins are examples of a type of the adhesive. Further, thermoplastic resin films such as polyurethane resins, nylon resins, denatured nylon resins, polyethylene terephthalate resins, polyvinyl chloride resins, polycarbonate resins, polyvinylidene chloride resins, ethyl cellulose resins, and acetylcellulose resins are examples of the resin film.

It should be noted that it is preferable that the resin film used have a high compatibility with prepreg matrix resins. For example, for cases where an epoxy resin or the like is used as a matrix resin, polyurethane resins, denatured nylon resins, and the like are suitable as the resin film. It is preferable that the thickness of the resin film be set from 0.02 to 0.2 mm.

Figure 11B:
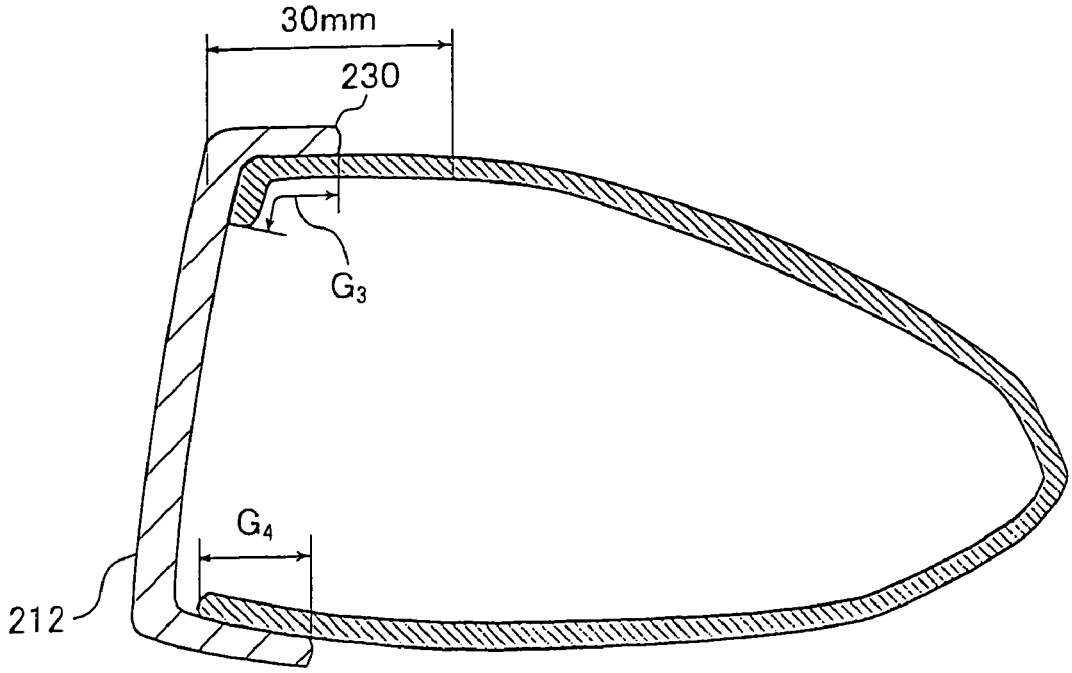

FIG. 11B is a cross sectional view of the golf club head shown in FIG. 10B taken along a line E-E as seen from the direction of arrows E, and shows a variation of the joining portion. In FIG. 11B, a portion of the joining portion that bonds to the face side crown portion is bent, and the back side crown portion is bonded to the face portion. The joining portion of the back side crown portion thus also contacts the face portion, not only the face side crown portion. However, in this case it is preferable that a length $G_3$ of the face side joining portion be from 8 mm to 30 mm, more preferably from 12 mm to 20 mm. Similarly, the joining portion of the back side sole portion may also contact the face portion, not only the face side sole portion. A length $G_4$ of the sole side joining portion may also contact the face portion at this point. In addition, the side portion (the toe portion and the heel portion) may also contact the face portion.

The hollow golf club head of the present invention is one in which at least two portions from among the crown portion, the heel portion, the sole portion, and the toe portion are divided into two portions along edges that are adjacent to the face portion, in regions within a range of 30 mm from the adjacent edges, having the first member that extends to the face portion and the second member that is made from a fiber reinforced plastic. In addition, the second member of the hollow golf club head is joined overlapping with the first member, forming the joining portion. The hollow golf club head of the present invention therefore has a structure that easily deforms with respect to golf ball impacts. The face portion deforms more than that of conventional face portions, and therefore the coefficient of restitution of a golf ball can be increased, the initial velocity of the golf ball can be increased, and the carry distance can be increased.

The hollow golf club of the present invention is explained in detail above, but the present invention is not limited to the embodiments described above. Various types of improvements and changes may of course be made within a range that does not deviate from the gist of the present invention.

INDUSTRIAL APPLICABILITY

At least two portions from among the crown portion, the heel portion, the sole portion, and the toe portion of the hollow golf club head of the present invention are along edges that are adjacent to the face portion, in regions within a range of 30 mm from the adjacent edges, and use at least one of a reinforced plastic material and a dissimilar metal that differs from a metallic material that configures the face portion. The flexural rigidity in these portions can therefore be made lower than the flexural rigidity of the face portion, and deformation of the face portion at a golf ball impact point becomes large. The coefficient of a struck golf ball can thus be increased, and the golf ball carry distance can be increased.

The invention claimed is:

1. A hollow golf club head, comprising a face portion having an impact surface that impacts a golf ball and is made from a metallic material, and a crown portion, a heel portion, a sole portion, and a toe portion that are adjacent to the face portion, wherein, in at least two portions from among the crown portion, the heel portion, the sole portion, and the toe portion, at least one material of dissimilar metallic material that differs from the metallic material and a fiber reinforced plastic material is used in regions along edges that are adjacent to the face portion, within a range of 30 mm from the adjacent edges, wherein said at least two portions from among the crown portion, the heel portion, the sole portion, and the toe portion are divided into two portions along the edges that are adjacent to the face portion, in regions within a range of 30 mm from the adjacent edges, each of said at least two portions having a first member that extends to the face portion and a second member as a portion other than the first member, wherein joining portions are formed by joining members made from a fiber reinforced plastic material, each joining member joining the first member and the second member of each of said at least two portions, said first members not overlapping said second members, and wherein a thickness $t_1$ of the first member which is joined by the joining member ranges from 0.5 to 2.0 mm, and a thickness $t_2$ of the joining member which joins to the second member ranges from 0.5 to 1.5 mm.

2. The hollow golf club head according to claim 1, wherein the dissimilar metallic material is an alloy material selected from the group consisting of titanium alloy, magnesium alloy, stainless steel alloy, and aluminum alloy.

3. The hollow golf club head according to claim 1, wherein an elastic modulus of fibers of the fiber reinforced plastic material is less than $27\times10^3$ kg-f/mm$^2$.

4. The hollow golf club head according to claim 1, wherein the first member and the second member respectively are joined to the joining member with an adhesive.

* * * * *